US007500863B2

(12) United States Patent
Ringler et al.

(10) Patent No.: US 7,500,863 B2
(45) Date of Patent: Mar. 10, 2009

(54) DIMM SOCKET POSITIVE LOCK EXTRACTOR

(75) Inventors: Daniel Robert Ringler, Elizabethville, PA (US); Jeffrey George Pennypacker, Corning, NY (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/764,939

(22) Filed: Jun. 19, 2007

(65) Prior Publication Data

US 2008/0318448 A1 Dec. 25, 2008

(51) Int. Cl.
*H01R 13/62* (2006.01)

(52) U.S. Cl. ..... 439/327; 439/159

(58) Field of Classification Search ..... 439/157, 439/159, 78, 155, 160, 327
See application file for complete search history.

(56) References Cited

U.S. PATENT DOCUMENTS 5,074,800 A 12/1991 Sasao et al.
5,511,985 A * 4/1996 Noschese et al. ..... 439/157
5,672,069 A * 9/1997 Cheng et al. ..... 439/160
5,746,614 A 5/1998 Cheng et al.
5,957,708 A 9/1999 Lin
5,980,282 A * 11/1999 Cheng ..... 439/157
6,290,519 B1 9/2001 Lee
6,319,027 B1 11/2001 Pickles et al.
6,599,142 B2 7/2003 Bu
6,616,466 B2 9/2003 Frantum, Jr. et al.
6,824,407 B1 * 11/2004 Zhao et al. ..... 439/157
6,955,550 B2 10/2005 Schlack
7,083,448 B2 8/2006 Tanigawa
7,233,500 B2 * 6/2007 Yu ..... 439/60

* cited by examiner

*Primary Examiner*—Briggitte R Hammond

(57) ABSTRACT

A card edge connector including a housing and a pair of extractors is disclosed for electrically connecting a first PCB such as a daughter card to a second PCB such as a motherboard. The extractors both secure and eject the daughter card from the connector. The extractors may be configured to reduce micro-motion of the daughter card by applying a vertical downward force thereto.

24 Claims, 9 Drawing Sheets

DIMM SOCKET POSITIVE LOCK EXTRACTOR

FIELD OF THE INVENTION

The present invention relates to card edge connectors, particularly to a card edge connector for both securing and ejecting a daughter board.

BACKGROUND OF THE INVENTION

Card edge connectors are used in computers and other electronic devices for establishing an electrical connection between a main printed circuit board (PCB) and a supporting PCB. The main PCB may be a motherboard, and the supporting PCB may be a daughter card. With the development of communication and computer technology, Dual In-line Memory Module (DIMM) cards have become more popular for use in the PC and electronics industry, and thus DIMM socket connectors mounted on a motherboard for receiving DIMM cards have been developed.

These connectors include a housing having a slot for receiving the card and electrical contacts to provide the electrical connection between the card and the motherboard. The card edge connector may include an ejector to assist in removal of the card from the connector. The ejector may also include a locking latch to secure the card. These ejectors have typically been an L-shaped lever mounted at an end of the slot. The lever pivots to provide an ejection force to the bottom of the card to assist in removal.

In prior art ejectors, the card is held in the slot by friction between the card and the housing. Environmental effects, including vibration, may cause the card to become loose within the slot, and may even cause the card to accidentally dislodge from the connector. Up to this time, no edge connector has been disclosed that provides an ejector mechanism that also securely mechanically supports the connection between the daughter card and the connector.

Therefore, there is an unmet need to provide an edge connector that includes an ejector that provides a secure mechanical retention support to a daughter card.

SUMMARY OF THE INVENTION

An edge connector for connecting a circuit card to a motherboard that includes a housing and an ejector mechanism that securely maintains the card connection to the connector is disclosed.

In a first exemplary embodiment of the invention, an edge connector is disclosed that includes a housing having a slot configured to receive a first PCB, a plurality of electrical terminals supported by the housing and extending into the slot for making electrical connection with the first PCB, and a pair of extractors rotatably attached to the housing at respective opposite ends of the slot and configured to eject the first PCB from the slot when the extractors are rotated away from the first PCB. At least one of the pair of extractors includes a latch configured to securely retain the first PCB within the slot.

The extractor further comprises a pair of side towers and a center tower, and the latch is attached to the center tower. The extractor further includes a base comprising a foot configured to apply force to the first PCB when the first PCB is ejected from the slot while the extractor is rotated away from the first PCB. The latch may be configured to apply a vertical force to the first PCB when the first PCB is secured within the slot. The base may further include a step that prohibits a first PCB having a straight edge from being inserted into the slot.

In an alternative embodiment, the extractor includes a latching side tower and a side tower, the latching side tower comprising the latch. The extractor further includes a base comprising a step configured to prohibit the first PCB from being inserted into the slot when the first PCB has a straight edge.

In another embodiment of the invention, a card edge connector is disclosed that includes a housing having a slot configured to receive a first PCB, a plurality of electrical terminals supported by the housing and extending into the slot for making an electrical connection with the first PCB, and a pair of extractors rotatably attached to the housing at respective opposite ends of the slot and configured to eject the first PCB from the slot when the extractors are rotated away from the first PCB. At least one of the extractors of the pair of extractors includes a base, a pair of side towers, and a center tower comprising a latch configured to secure the first PCB when the extractor is rotated towards the first PCB. The latch is compliant and configured to provide a positive retention force to the first PCB when the first PCB is secured in the connector by the extractor. The base comprises a step configured to prohibit the first PCB from being inserted into the slot when the first PCB has a straight edge.

In yet another embodiment of the invention, a method of securing a first PCB to a card edge connector is disclosed that includes providing a connector comprising a housing having a slot configured to receive the first PCB. The connector includes a plurality of electrical terminals supported by the housing and extending into the slot for making electrical connection with the first PCB, and a pair of extractors rotatably attached to the housing at respective opposite ends of the slot and configured to secure the first PCB within the slot when the extractors are rotated towards the first PCB. At least on of the pair of extractors comprises a latch configured to securely retain the first PCB within the slot. The method further includes inserting the first PCB having a notch into the slot and rotating the pair of extractors toward the first PCB to insert the latch of the extractor into the notch of the PCB. The method further includes rotating the extractors away from the first PCB causing the first PCB to be ejected from the slot.

An embodiment of the extractor used in the method includes a pair of side towers and a center tower, and the latch is attached to the center tower. The extractor further includes a base comprising a foot configured to apply force to the first PCB when the first PCB is ejected from the slot while the extractor is rotated away from the first PCB. The latch may be configured to apply a vertical force to the first PCB when the first PCB is secured within the slot. The base may further include a step configured to prohibit the first PCB from being inserted into the slot when the first PCB has a straight edge.

Another embodiment of the extractor used in the method includes a latching side tower and a side tower, the latching side tower comprising the latch. The extractor further includes a base comprising a step configured to prohibit the first PCB from being inserted into the slot when the first PCB has a straight edge.

Further aspects of the method and system are disclosed herein. The features as discussed above, as well as other features and advantages of the present invention will be appreciated and understood by those skilled in the art from the following detailed description and drawings.

DETAILED DESCRIPTION OF THE INVENTION

The present invention now will be described more fully hereinafter with reference to the accompanying drawing, in which a preferred embodiment of the invention is shown. This invention may, however, be embodied in many different forms and should not be construed as limited to the embodiments set forth herein; rather, these embodiments are provided so that this disclosure will be thorough and complete and will fully convey the scope of the invention to those skilled in the art.

Figure 1:
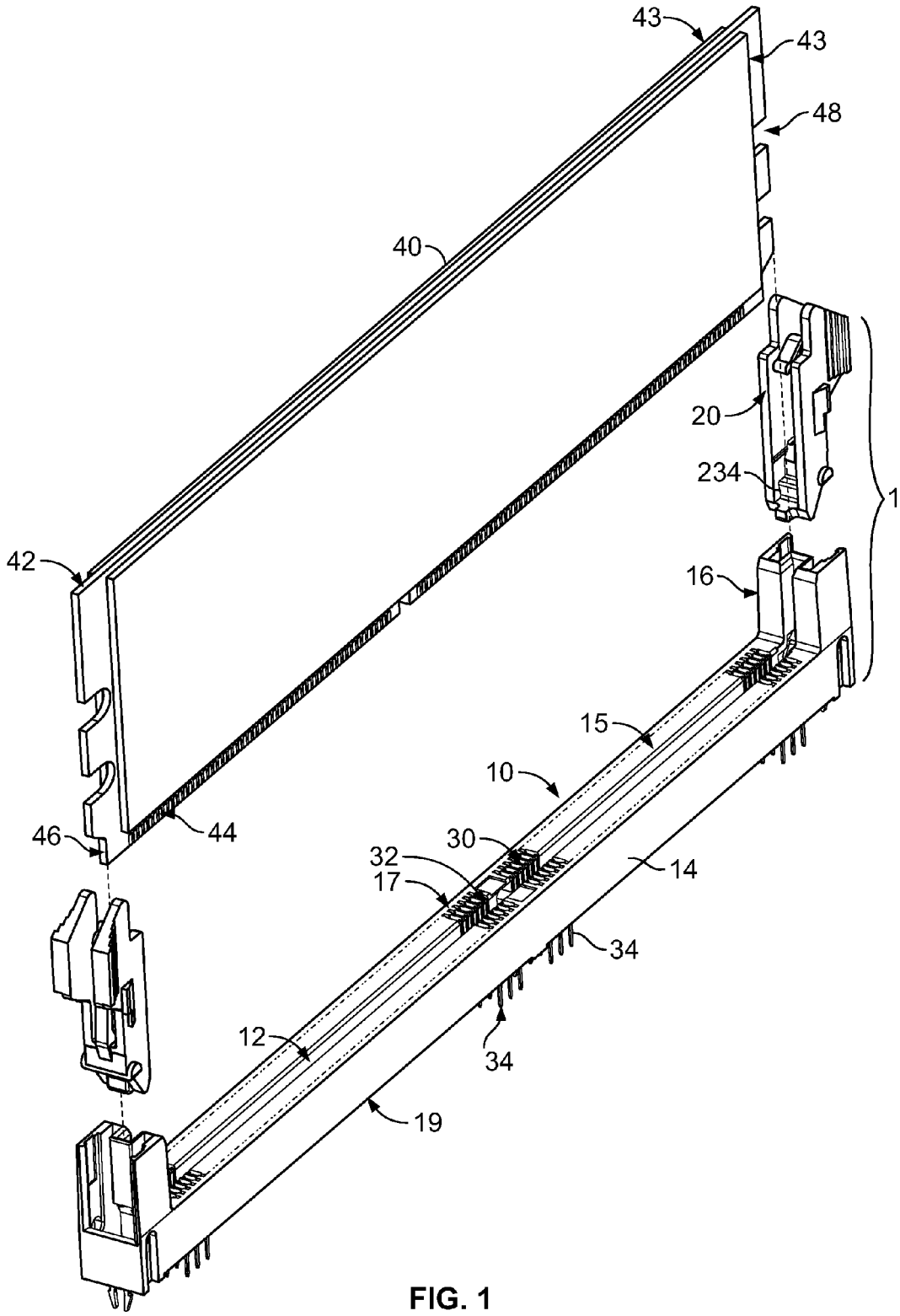
FIG. 1 illustrates an exploded view of an exemplary electrical connector and daughter card according to a first embodiment of the invention.
Figure 4:
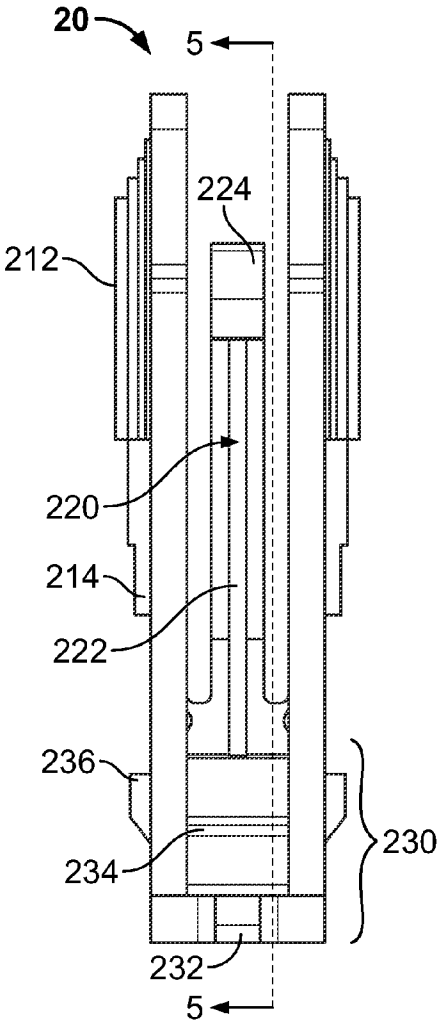
FIG. 4 illustrates a full frontal view of an exemplary extractor according to the first embodiment of the invention.
Figure 3:
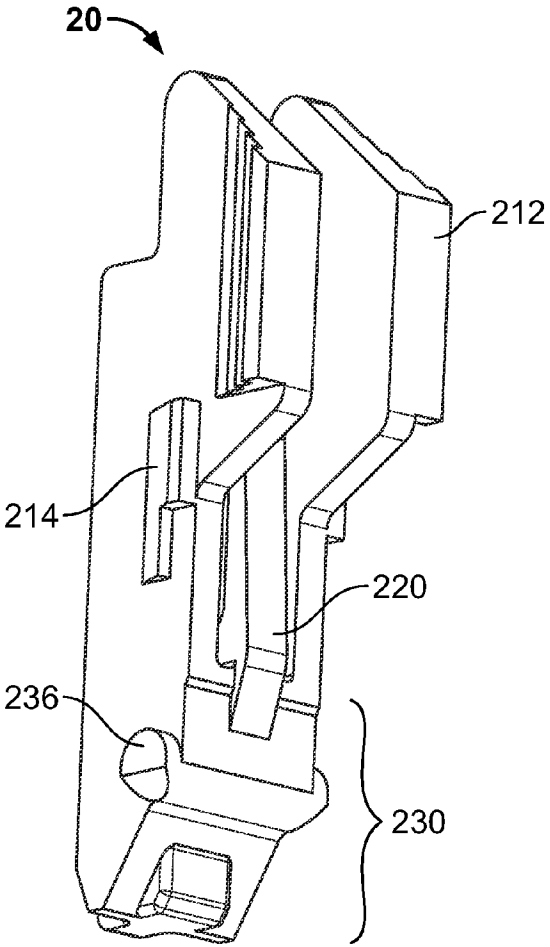
FIG. 3 illustrates an enlarged perspective rear view of an exemplary extractor according to the first embodiment of the invention.

Referring to FIG. 1, a first embodiment of an exemplary card edge connector 1 is shown. Connector 1 includes a housing 10 having a slot 12, a pair of extractors 20 are rotatably attached to the housing 10 at respective opposite ends of the slot 12, and a plurality of conductive terminals 30 supported by the housing 10 and extending into the slot 12. The slot 12 is configured to receive a first PCB such as a daughter card 40 therein. The plurality of conductive terminals make an electrical connection with the daughter card 40 when the daughter card 40 is received in the slot 12. The pair of extractors 20 is configured to eject the daughter card 40 from the slot 12 when the extractors 20 are rotated away from the daughter card 40. It should be appreciated by one of ordinary skill that known extractors with or without latches may be substituted for one of the extractors 20 of the present invention.

Daughter card 40 includes a printed circuit board 42 supporting circuit board components 43. The PCB 42 further supports a plurality of contact pads 44. Daughter card 40 further includes a corner notch 46 and a securing notch 48 formed into the PCB 42. The terminals 30 provide an electrical path between the contact pads 44 of the daughter card 40 and a second PCB (not shown) such as a motherboard. The extractors 20 are configured to both secure the daughter card 40 within the slot 12 and to eject the daughter card 40 from the slot 12.

The housing 10 includes a middle section 14 having a top surface 15 and a pair of end extractor supports 16 configured to receive the extractors 20. The middle section 14 defines the slot 12 in a longitudinal direction extending toward opposite ends thereof. The middle section 14 includes terminal receiving passageways 17 on the top surface 15 for receiving the conductive terminals 30.

The terminals 30 include a mating portion 32 that extends into the slot 12 for electrical connection with a corresponding contact pad 44 of the daughter card 40, a body portion (not shown) passing through the receiving passageways 17 of the housing 10, and a tail portion 34 extending beyond a bottom surface 19 of the housing 10 for electrically connecting with a motherboard (not shown).

A more detailed view of an exemplary embodiment of the extractor 20 is shown in FIGS. 2, 3, 4 and 5. Extractor 20 includes a pair of side towers 210 and a center tower 220 extending from a base 230. Side towers 210 include squeeze tabs 212 and retention tabs 214. The center tower 220 includes a stem 222 and a compliant latch 224. Base 230 includes a foot 232, a step 234 and two opposed pivoting protrusions 236. The side towers 210 are compliant to allow lateral movement towards the center tower 220 when the tabs 212 are pressed towards one another.

The step 234 may be used to prevent certain types of cards from being inserted into the connector 10 (FIG. 1). For example, as shown in FIG. 1, a daughter card 40 having a corner notch 42 in a corner, for example a FB DIMM card, may be inserted into a connector 1 having an extractor 20 having a step 234. However, daughter cards without a corner notch would be prevented from being inserted into connector 1 (FIG. 1).

Figure 6A:
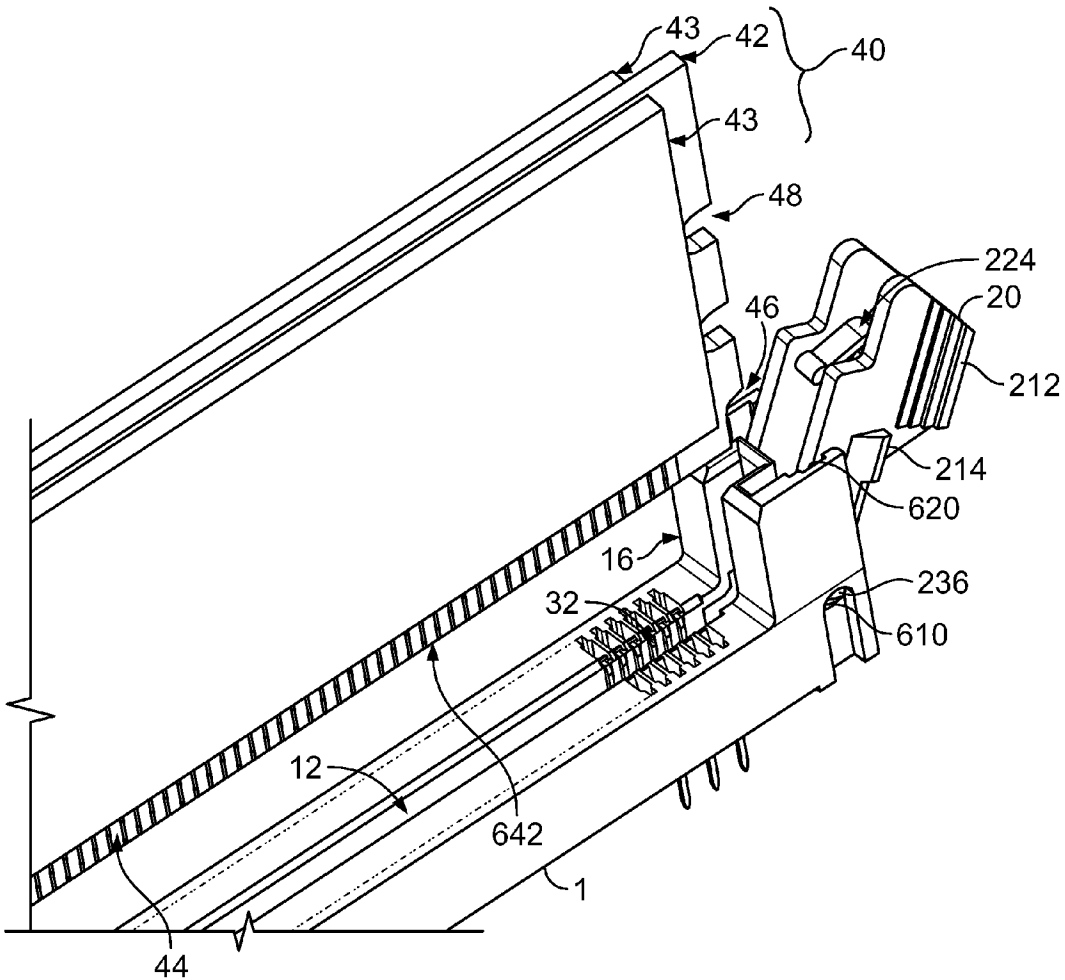
FIG. 6A illustrates an enlarged partial perspective view of an exemplary daughter card about to be inserted into the electrical connector according to the first embodiment of the invention.
Figure 5:
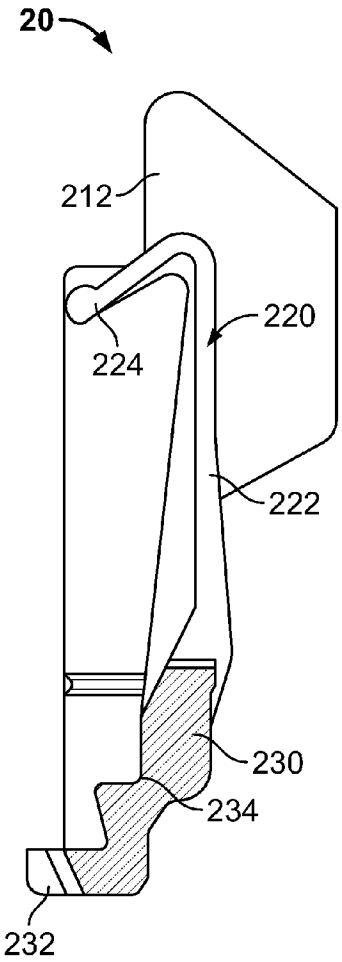
FIG. 5 illustrates a cross-sectional view taken along line 5-5 of FIG. 4.

FIG. 6A shows an enlarged view of daughter card 40 about to be inserted into the connector 1. The extractor 20 is shown in an open position rotated away from card 40. As shown in FIG. 6A, the pivoting protrusions 236 are received in recesses 610 formed in the end extractor support 16, allowing the extractor 20 to rotate with respect to the extractor support 16.

Figure 6B:
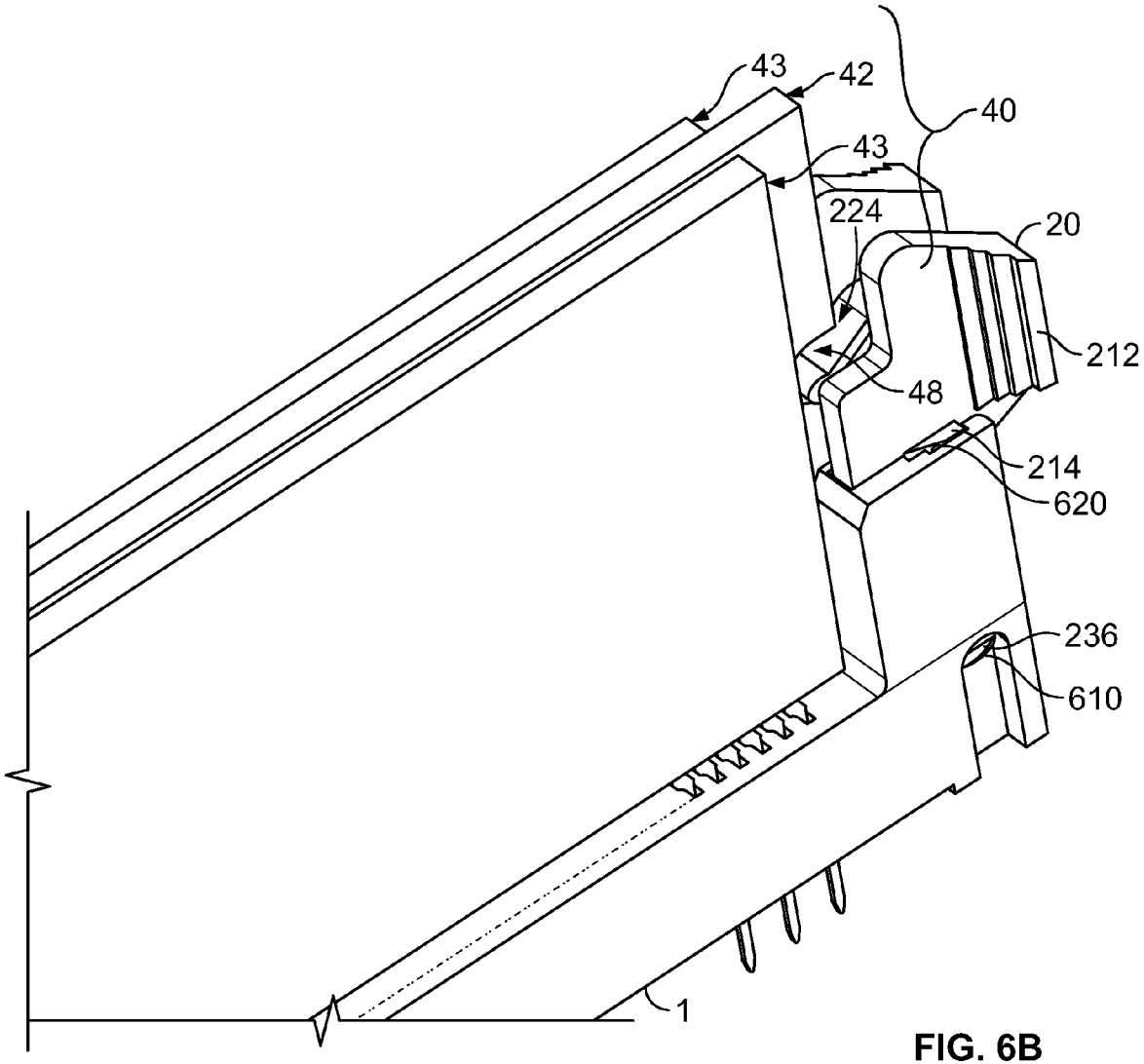
FIG. 6B illustrates an enlarged partial perspective view of an exemplary daughter card about inserted into the electrical connector according to the first embodiment of the invention.

To fully insert and secure the daughter card 40 into the connector 1, the card 40 is inserted until the card bottom surface 642 comes into contact with the bottom surface (not shown) of the slot 12. At this point, the contact pads 44 are in electrical contact with the conductive terminal mating portions 32. The extractor 20 is then rotated forward towards the card 40 until the latch 224 is received in the notch 48 at which point the extractor 20 is in a closed position as shown in FIG. 6B. The latch 224 is configured to apply a downward vertical force to the notch 48 to reduce micro-motion of the card 40 when the extractor 20 is in the closed position. The latch 224 also prevents the card 40 from being removed from the connector 1 while the extractor 20 is in the closed position.

The retention tabs 214 are configured to press inward towards the center tower 220 when the extractor 20 is rotated forward towards extractor supports 16. The squeeze tabs 212 may be pressed inward during the rotation to reduce the amount of force necessary to rotate the extractor 20 forward. The end extractor support 16 includes slots 620 that engage the retention tabs 214 when the extractor 20 is fully rotated forward into the closed position. The slots 620 prevent the extractor 20 from rotating away from the card 40 unless the tabs 212 are pressed together, disengaging the retention tabs 214 from the slots 620.

To remove the card 40 from the connector 1, the tabs 212 are pressed together and the extractor 20 is rotated outward and away from the card 40. Pressing the tabs 212 inward disengages the tabs 214 from the slots 620, allowing the extractor 20 to be outwardly rotated. During rotation, the foot 232 (shown in FIG. 2) of the extractor 20 applies a force to the card bottom surface 642 until the card 40 becomes disengaged from the connector 1.

Figure 2:
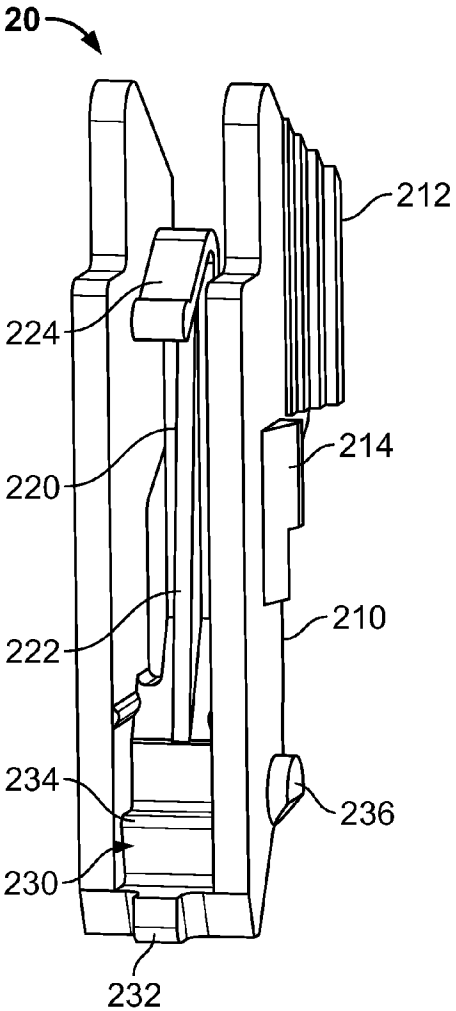
FIG. 2 illustrates a frontal view of an exemplary extractor according to the first embodiment of the invention.
Figure 8A:
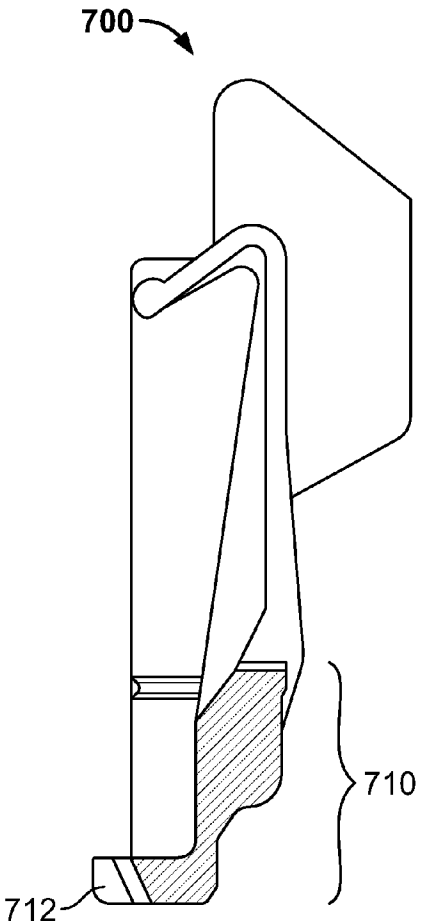
FIG. 8A illustrates a cross-sectional view taken along line 8A-8A of FIG. 8.
Figure 8:
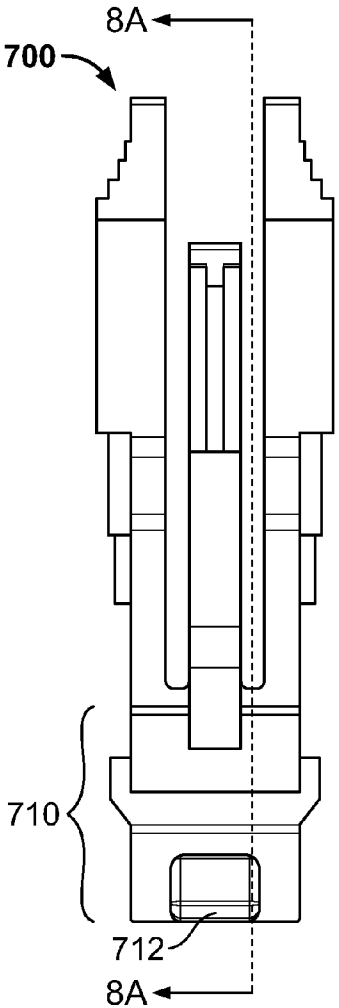
FIG. 8 illustrates a full frontal view of the alternative embodiment of FIG. 7 of an extractor according to the invention.
Figure 7:
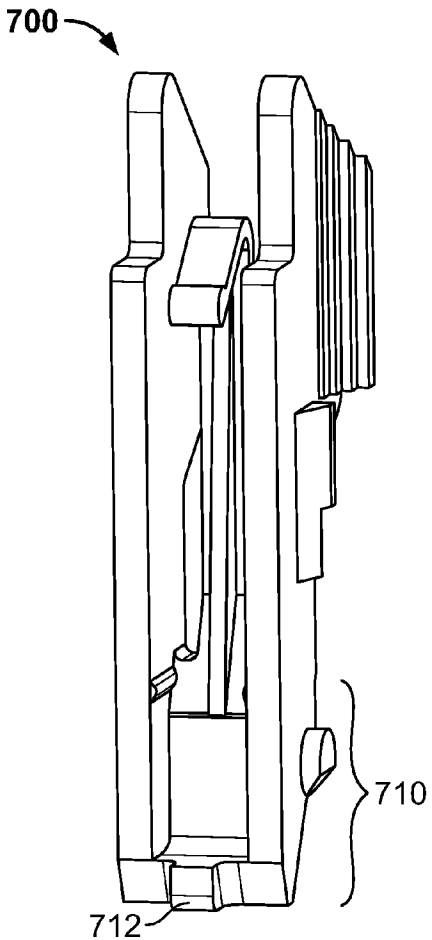
FIG. 7 illustrates an enlarged perspective view of an alternative embodiment of an extractor according to the invention.

An alternative exemplary embodiment of an extractor 700 is shown in FIGS. 7, 8, and 8A. Extractor 700 includes a base 710 having a foot 712. As can be seen in FIGS. 7, 8, and 8A, the base 710 does not include a step such as step 234 of extractor 20 (FIG. 2). Thus, the extractor 700 may be used in connectors to connect straight edge PCBs not having a corner notch.

Figure 9:
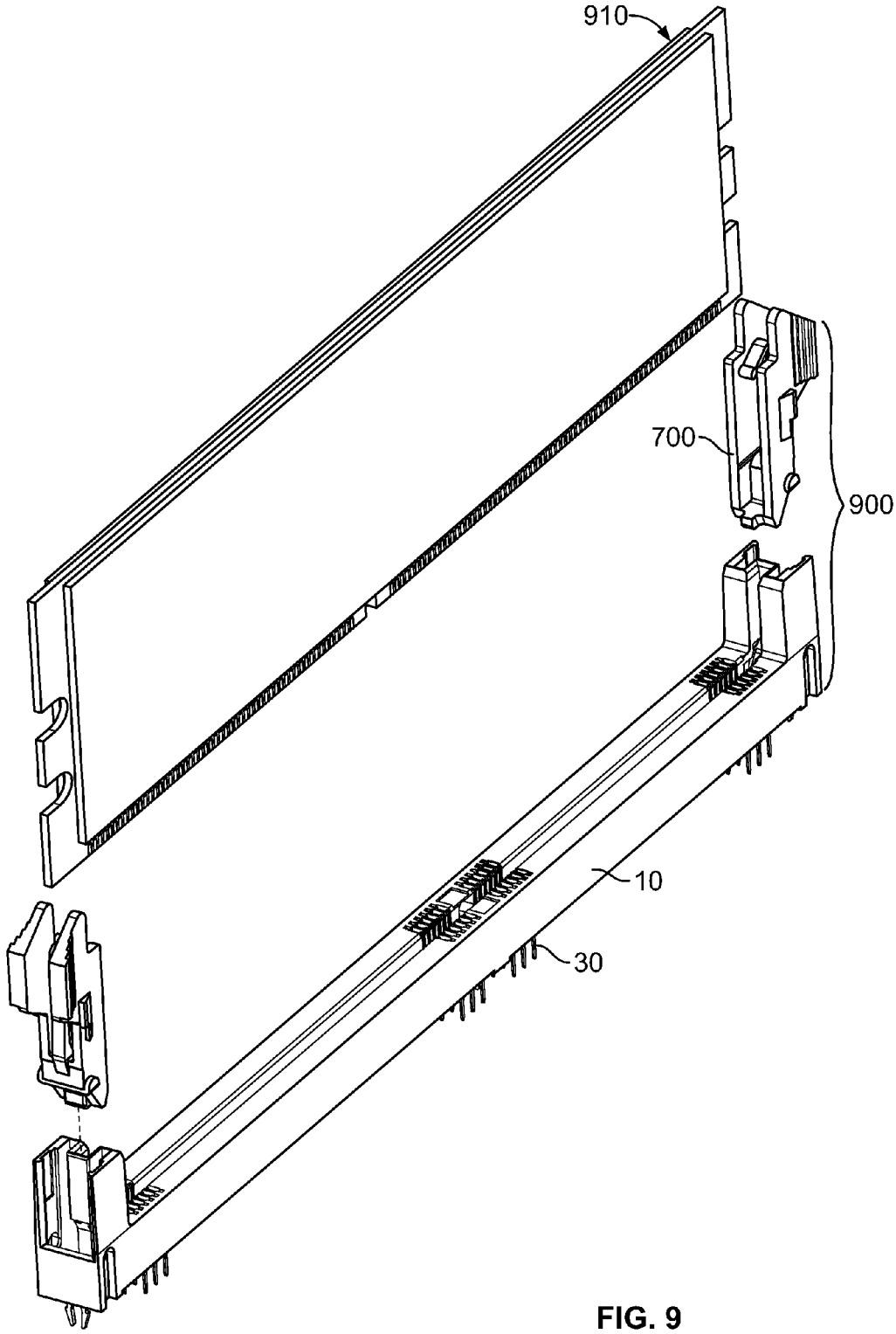
FIG. 9 illustrates an exploded view of an exemplary daughter card and exemplary alternative electrical connector.
Figure 12:
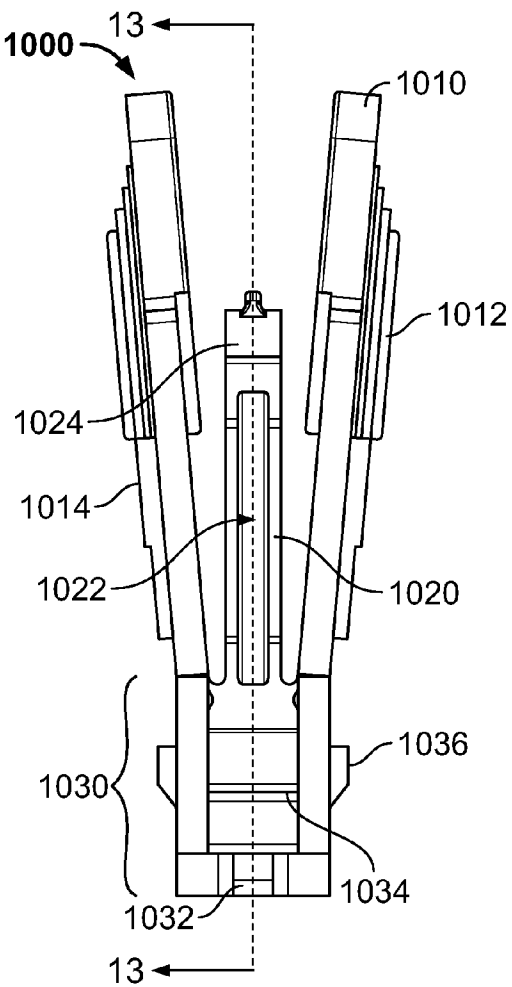
FIG. 12 illustrates a full frontal view of an exemplary extractor according to the second embodiment of the invention.
Figure 11:
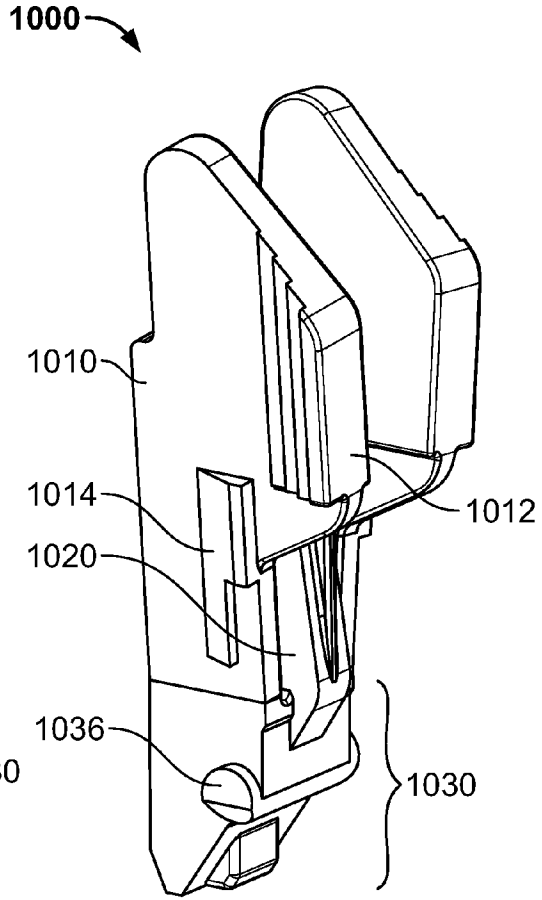
FIG. 11 illustrates an enlarged perspective rear view of an exemplary extractor according to the second embodiment of the invention.
Figure 10:
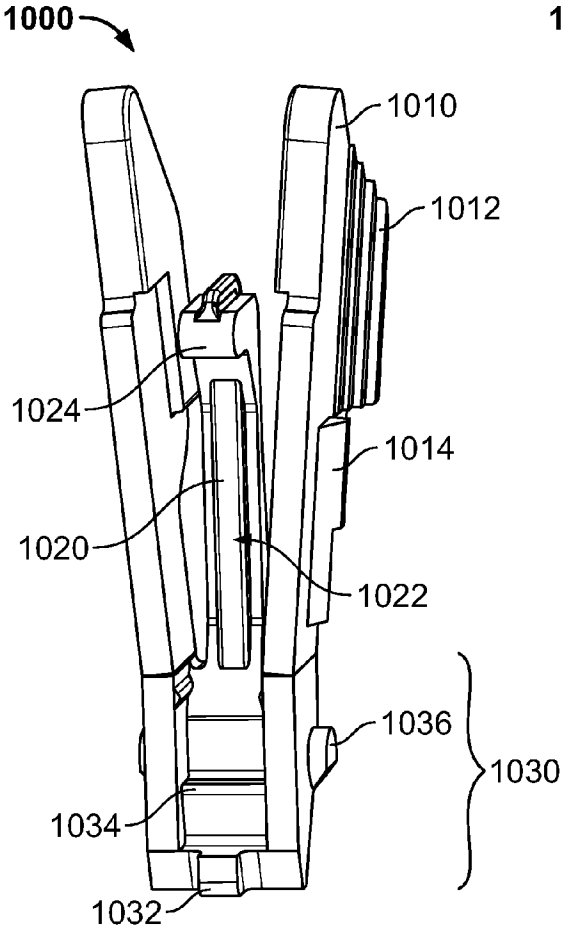
FIG. 10 illustrates an enlarged perspective frontal view of an exemplary extractor according to a second embodiment of the invention.
Figure 15:
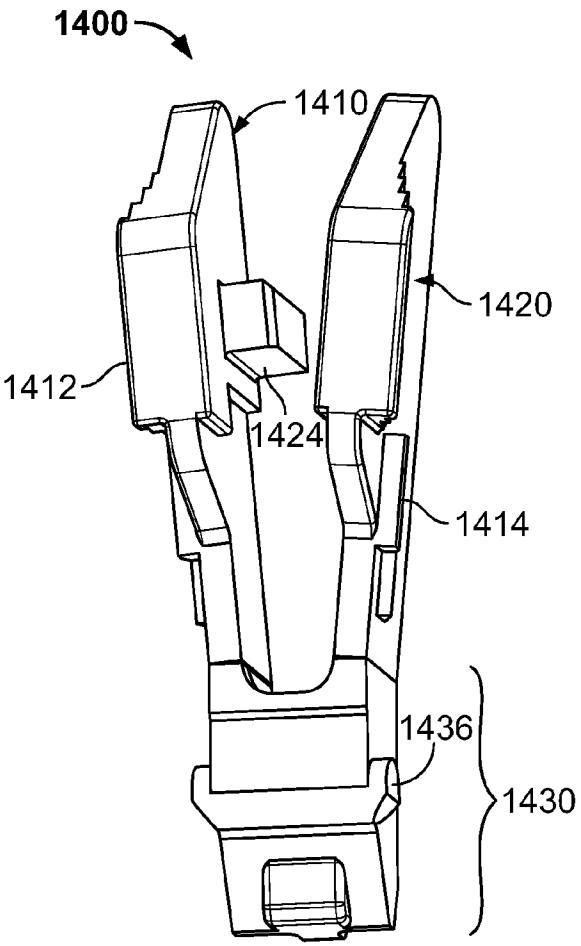
FIG. 15 illustrates an enlarged perspective rear view of an exemplary extractor according to the third embodiment of the invention.
Figure 14:
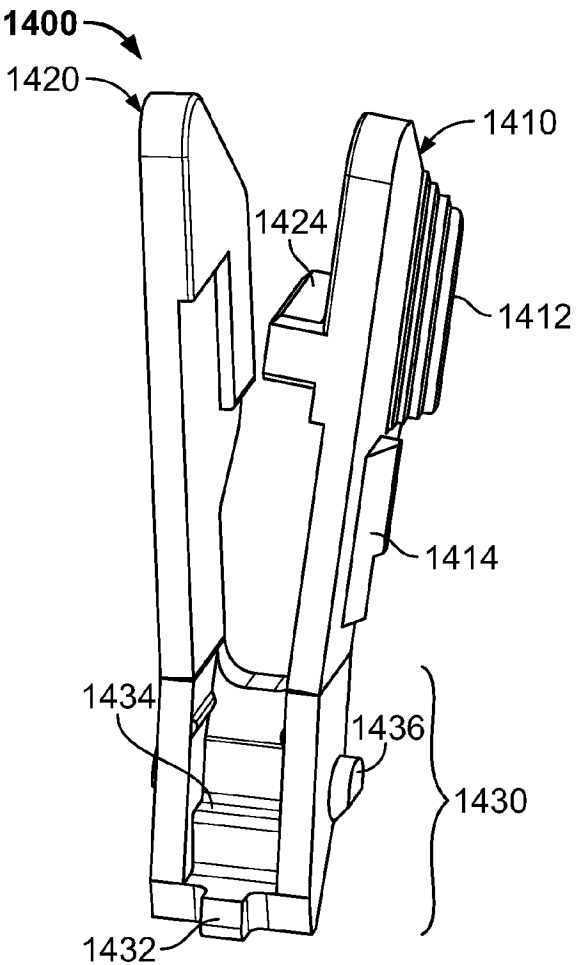
FIG. 14 illustrates an enlarged perspective frontal view of an exemplary extractor according to a third embodiment of the invention.
Figure 13:
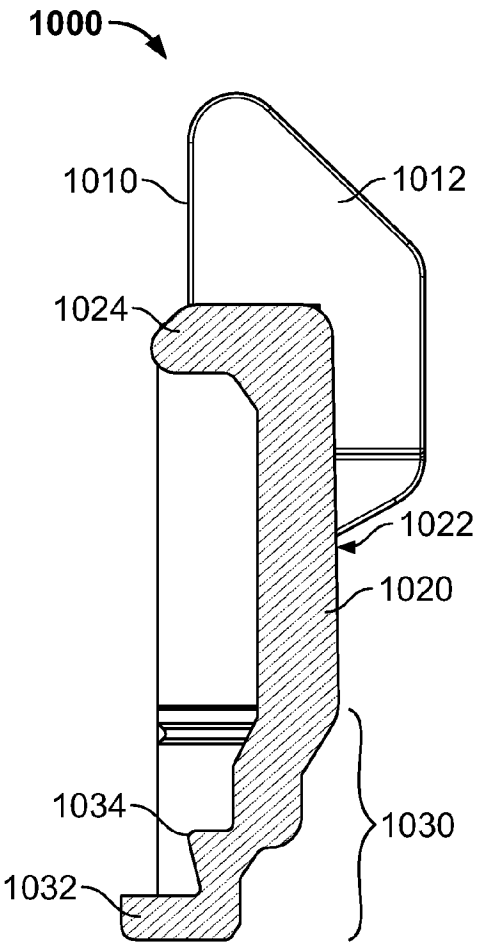
FIG. 13 illustrates a cross-sectional view taken along line 13-13 of FIG. 12.
Figure 17:
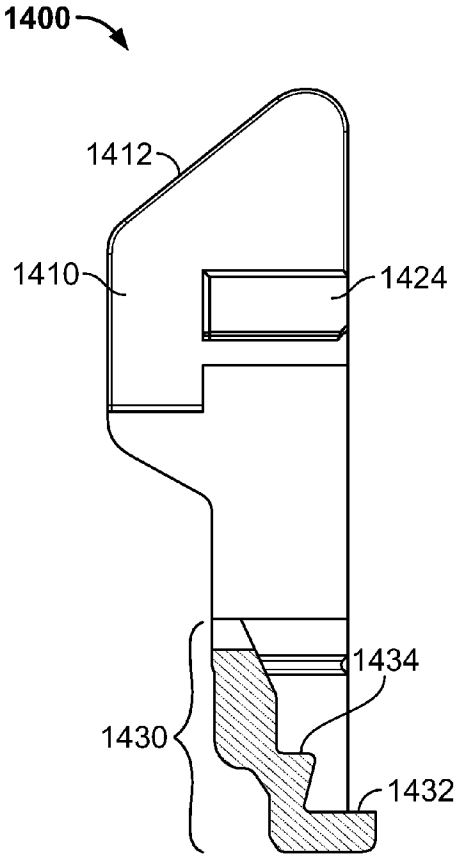
FIG. 17 illustrates a cross-sectional view taken along line 17-17 of FIG. 16.
Figure 16:
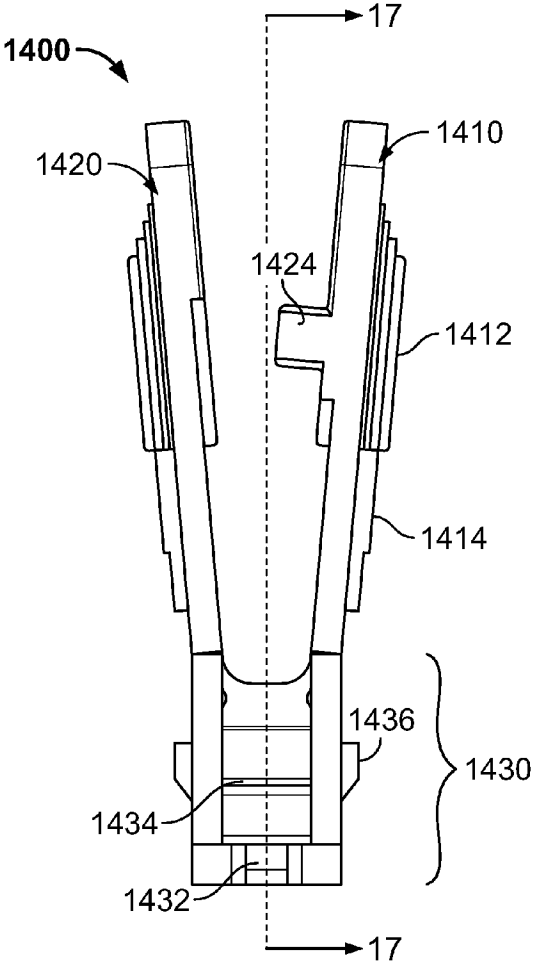
FIG. 16 illustrates a full frontal view of an exemplary extractor according to the third embodiment of the invention.

An exemplary embodiment of a card edge connector 900 having a pair of extractors 700 for connecting a daughter card 910 is shown in FIG. 9. As can be seen in FIG. 9, the daughter card 910 does not have a corner notch. Extractor 700, not having a step, will be able to receive and secure the card 910 in the connector 1.

A second alternative exemplary embodiment of an extractor 1000 is shown in FIGS. 10, 11, 12 and 13. Extractor 1000 includes a pair of side towers 1010 and a center tower 1020 extending from a base 1030. The side towers 1010 include squeeze tabs 1012 and retention tabs 1014. The center tower 1020 includes a stem 1022 and a latch 1024. Base 1030 includes a foot 1032, a step 1034 and opposed pivoting protrusions 1036. The side towers 1010 are compliant to allow lateral movement towards each other when the tabs 1012 are pressed towards one another.

Extractor 1000 is provided with a step 1034 that would prohibit a straight edge PCB from being inserted into a connector using extractor 1000. Alternately, the extractor 1000 could be modified to remove the step 1034 to allow straight edge PCBs to be used. The extractor 1000 operates in a connector in a similar manner to extractor 20 of FIG. 1. However, the latch 1024 is not compliant and is configured to engage a notch formed in a PCB without applying a downward vertical force to the PCB.

A third alternative exemplary embodiment of an extractor 1400 is shown in FIGS. 14, 15, 16 and 17. Extractor 1400 includes a latching side tower 1410 and a side tower 1420 extended from a base 1430. Both the latching side tower 1410 and the side tower 1420 include squeeze tabs 1412 and retention tabs 1414. The latching side tower 1410 includes a latch 1424. Base section 1430 includes a foot 1432, a step 1434 and opposed pivoting protrusions 1436. The latching side tower 1410 and the side tower 1420 are compliant to allow lateral movement towards each other when the tabs 1412 are pressed towards one another.

Extractor 1400 is provided with a step 1434 that would prohibit a straight edge PCB from being inserted into a connector using extractor 1400. Alternately, the extractor 1400 could be modified to remove the step 1434 to allow straight edge PCBs to be used. The extractor 1400 operates in a connector in a similar manner to extractor 20 of FIG. 1. However, the latch 1424 of connector 1400 is configured to not apply a downward vertical force to a PCB when the latch 1424 is engaged in a notch in the PCB.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A card edge connector, comprising:

a housing having a card receiving slot configured to receive a first PCB;

a plurality of electrical terminals supported by the housing and extending into the slot for making electrical connection with the first PCB; and a pair of extractors rotatably attached to the housing and configured to eject the first PCB from the slot when rotated away from the first PCB;

wherein at least one extractor comprises at least two towers separately and independently extending from a base and at least one of the two towers comprises a latch configured to securely retain the first PCB within the slot.

2. The card edge connector of claim 1, wherein the base further comprises a step configured to prohibit the first PCB from being inserted into the slot when the first PCB has a straight edge.

3. The card edge connector of claim 1, wherein the at least two towers comprise a pair of side towers and a center tower, and the latch being disposed on the center tower.

4. The card edge connector of claim 3, wherein the base comprises a foot configured to apply force to the first PCB when the first PCB is ejected from the slot while the extractor is rotated away from the first PCB.

5. The card edge connector of claim 4, wherein the base further comprises a step that prohibits a first PCB having a straight edge from being inserted into the slot.

6. The card edge connector of claim 4, wherein the latch is configured to apply a vertical force to the first PCB when the first PCB is secured within the slot.

7. The card edge connector of claim 6, wherein the base further comprises a step configured to prohibit the first PCB from being inserted into the slot when the first PCB has a straight edge.

8. The card edge connector of claim 1, wherein the at least two towers include tabs configured to engage tab-retention slots of the housing.

9. The card edge connector of claim 8, wherein the at least two towers further include squeeze tabs configured to receive a pressing force to disengage the tabs of the at least two towers from the tab retention slots of the housing.

10. A card edge connector, comprising:

a housing having a slot configured to receive a first PCB;

a plurality of electrical terminals supported by the housing and extending into the slot for making an electrical connection with the first PCB; and a pair of extractors rotatably attached to the housing at respective opposite ends of the slot and configured to eject the first PCB from the slot when rotated away from the first PCB;

wherein at least one extractor of the pair of extractors comprises a base, a pair of side towers and a center tower, the pair of side towers and the center tower extending separately and independently from the base, and a latch disposed on the center tower configured to secure the first PCB when the extractor is rotated towards the first PCB.

11. The card edge connector of claim 10, wherein the latch is compliant and configured to provide a positive retention force to the first PCB when the first PCB is secured in the connector by the extractor.

12. The card edge connector of claim 10, wherein the base comprises a step configured to prohibit the first PCB from being inserted into the slot when the first PCB has a straight edge.

13. The card edge connector of claim 10, wherein the pair of side towers include tabs configured to engage tab retention slots in the housing.

14. The card edge connector of claim 13, wherein the pair of side towers further include squeeze tabs configured to receive a pressing force to disengage the tabs of the pair of side towers from the tab retention slots in the housing.

15. A method of securing a first PCB to a card edge connector, comprising:

providing a connector comprising a housing having a slot configured to receive the first PCB;

the connector further comprising:

a plurality of electrical terminals supported by the housing and extending into the slot for forming an electrical connection with the first PCB; and a pair of extractors rotatably attached to the housing at respective opposite ends of the slot and configured to secure the first PCB within the slot when the extractors are rotated towards the first PCB;

wherein at least one extractor of the pair of extractors comprises at least two towers that extend separately and independently from a base, and at least one of the two towers comprises a latch configured to securely retain the first PCB within the slot;

inserting the first PCB having a notch into the slot; and rotating the pair of extractors toward the first PCB to insert the latch of the extractor into the notch of the PCB.

16. The method of claim 15, wherein the base comprises a step configured to prohibit the first PCB from being inserted into the slot when the first PCB has a straight edge.

17. The method of claim 15, further comprising:

rotating the extractors away from the first PCB causing the first PCB to be ejected from the slot.

18. The method of claim 15, wherein the at least two towers comprise a pair of side towers and a center tower, and the latch is attached to the center tower.

19. The method of claim 18, wherein the base comprises a foot configured to apply force to the first PCB when the first PCB is ejected from the slot while the extractor is rotated away from the first PCB.

20. The method of claim 19, wherein the base further comprises a step that prohibits a first PCB having a straight edge from being inserted into the slot.

21. The method of claim 19, wherein the latch is configured to apply a vertical force to the first PCB when the first PCB is secured within the slot.

22. The method of claim 21, wherein the base further comprises a step configured to prohibit the first PCB from being inserted into the slot when the first PCB has a straight edge.

23. The method of claim 15, wherein the at least two towers include tabs that engage tab retention slots in the housing when the at least one extractor of the pair of extractors is rotated toward the first PCB to a closed position.

24. The method of claim 23, wherein the pair of side towers further includes squeeze tabs for receiving a pressing force to disengage the tabs of the at least one extractor from the tab retention slots in the housing.

* * * * *